US005963997A

United States Patent [19]

Hagopian

[11] Patent Number: 5,963,997

[45] Date of Patent: Oct. 12, 1999

[54] LOW AIR LOSS PATIENT SUPPORT SYSTEM PROVIDING ACTIVE FEEDBACK PRESSURE SENSING AND CORRECTION CAPABILITIES FOR USE AS A BED MATTRESS AND A WHEELCHAIR SEATING SYSTEM

[76] Inventor: Mark Hagopian, 418 Saint Andrew Dr., Belleair, Fla. 34616

[21] Appl. No.: 08/823,102

[22] Filed: Mar. 24, 1997

[51] Int. Cl.[6] ..... A47C 27/10; A47C 27/08

[52] U.S. Cl. ..... 5/654; 5/655.3; 5/713; 5/710

[58] Field of Search ..... 5/706, 710, 713, 5/714, 655.3, 914, 654

[56] References Cited

U.S. PATENT DOCUMENTS

| | | | |
|---|---|---|---|
| 2,719,986 | 10/1955 | Rand | 5/348 |
| 2,998,817 | 9/1961 | Armstrong | 128/33 |
| 3,148,391 | 9/1964 | Whitney | 5/348 |
| 3,192,540 | 7/1965 | Swank | 5/655.3 |
| 3,297,023 | 1/1967 | Foley | 128/33 |
| 3,394,415 | 7/1968 | Parker | 5/348 |
| 3,462,778 | 8/1969 | Whitney | 5/347 |
| 3,477,071 | 11/1969 | Emerson | 5/61 |
| 3,653,083 | 4/1972 | Lapidus | 5/348 |
| 3,778,851 | 12/1973 | Howorth | 5/347 |
| 3,867,732 | 2/1975 | Morrell | 5/349 |
| 4,175,297 | 11/1979 | Robbins et al. | 5/284 |
| 4,193,149 | 3/1980 | Welch | 5/447 |
| 4,197,837 | 4/1980 | Tringali et al. | 128/33 |
| 4,267,611 | 5/1981 | Agulnick | 5/453 |
| 4,391,009 | 7/1983 | Schild et al. | 5/453 |
| 4,524,762 | 6/1985 | Schulman | 128/33 |
| 4,638,519 | 1/1987 | Hess | 5/455 |
| 4,653,130 | 3/1987 | Senoue et al. | 5/453 |
| 4,679,264 | 7/1987 | Mollura | 5/706 X |
| 4,685,163 | 8/1987 | Quillen et al. | 5/455 |
| 4,711,275 | 12/1987 | Ford et al. | 5/710 X |
| 4,796,948 | 1/1989 | Paul et al. | 297/284 |
| 4,797,962 | 1/1989 | Goode | 5/713 |
| 4,799,276 | 1/1989 | Kadish | 5/446 |
| 4,833,614 | 5/1989 | Saitoh et al. | 364/424 |
| 4,852,195 | 8/1989 | Schulman | 5/453 |
| 4,864,671 | 9/1989 | Evans | 5/453 |
| 4,923,248 | 5/1990 | Feher | 297/180 |
| 4,946,220 | 8/1990 | Wyon et al. | 297/180 |
| 4,953,247 | 9/1990 | Hasty | 5/453 |
| 5,003,654 | 4/1991 | Vrzalik | 5/453 |
| 5,010,608 | 4/1991 | Barnett et al. | 5/453 |
| 5,020,176 | 6/1991 | Dotson | 5/710 |
| 5,022,110 | 6/1991 | Stroh | 5/714 X |
| 5,044,029 | 9/1991 | Vrzalik | 5/453 |
| 5,052,067 | 10/1991 | Thomas et al. | 5/453 |
| 5,068,935 | 12/1991 | Hagopian | 5/451 |
| 5,072,468 | 12/1991 | Hagopoian | 5/451 |
| 5,103,518 | 4/1992 | Gilroy et al. | 5/453 |
| 5,193,237 | 3/1993 | Holdredge | 5/654 |
| 5,235,713 | 8/1993 | Guthrie et al. | 5/713 X |
| 5,243,721 | 9/1993 | Teasdale | 5/453 |
| 5,267,364 | 12/1993 | Volk | 5/453 |
| 5,282,286 | 2/1994 | MacLeish | 5/654 |
| 5,288,135 | 2/1994 | Forcier et al. | 294/452.21 |
| 5,301,457 | 4/1994 | Seely | 43/132.1 |
| 5,325,551 | 7/1994 | Tappel et al. | 5/714 X |
| 5,369,828 | 12/1994 | Graebe | 5/654 |
| 5,379,471 | 1/1995 | Holdredge | 5/456 |

(List continued on next page.)

*Primary Examiner*—Michael F. Trettel
*Assistant Examiner*—Robert G. Santos
*Attorney, Agent, or Firm*—Joseph C. Mason, Jr.; Dennis G. LaPointe

[57] ABSTRACT

A low air loss therapeutic air support system which simultaneously prevents the development of pressure sores and skin maceration due to the build up of heat and moisture at points of interface between the device and the patient and has an active feedback system which provides for real time adjustments to the inflation pressure of the support surface in response to an increase in the compressive pressure on a part of the support surface from shifting of the patient's position or other causes which can be used interchangeably with a sleeping surface and a wheelchair seating system.

4 Claims, 5 Drawing Sheets

U.S. PATENT DOCUMENTS

| | | | |
|---|---|---|---|
| 5,393,935 | 2/1995 | Hasty et al. | 177/45 |
| 5,487,196 | 1/1996 | Wilkinson et al. | 5/715 |
| 5,500,965 | 3/1996 | Hannagan et al. | 5/654 |
| 5,509,155 | 4/1996 | Zigarac et al. | 5/453 |
| 5,533,217 | 7/1996 | Holdredge | 5/453 |
| 5,539,942 | 7/1996 | Melou | 5/655.3 |
| 5,586,346 | 12/1996 | Stacy et al. | 5/706 X |
| 5,606,754 | 3/1997 | Hand et al. | 5/713 |
| 5,611,096 | 3/1997 | Bartlett et al. | 5/710 X |
| 5,655,239 | 8/1997 | Caparon et al. | 5/914 X |
| 5,685,036 | 11/1997 | Kopfstein et al. | 5/713 |
| 5,701,622 | 12/1997 | Biggie et al. | 5/713 |

LOW AIR LOSS PATIENT SUPPORT SYSTEM PROVIDING ACTIVE FEEDBACK PRESSURE SENSING AND CORRECTION CAPABILITIES FOR USE AS A BED MATTRESS AND A WHEELCHAIR SEATING SYSTEM

FIELD OF THE INVENTION

This invention relates, generally, to an improved air-operated, low air loss, active feedback patient support system. More particularly, it relates to an improved self-contained corrective, low air loss, dynamic patient body weight air support system which has active feedback pressure sensing and real time automatic pressure correction capabilities for use on a sleeping surface and/or as a wheelchair therapeutic pressure relief system.

BACKGROUND OF THE INVENTION

The capillary occlusion pressure threshold is 32 mm Hg. Pressures above 32 mm Hg result in capillary closure which occludes blood flow to the tissue. Decubitus ulcers occur when the blood flow through the skin capillaries is occluded due to the compression of tissue for a prolonged period of time. Decubitus ulcers, which are also referred to as pressure ulcers, pressure sores and bedsores, are a pervasive problem in the health care field. The most crucial factors in the formation of decubitus ulcers are the intensity and duration of the pressure being applied to the area of the patient's body.

There are a variety of systems available that are intended to reduce the formation of decubitus ulcers. These systems are either static devices or dynamic devices. Static devices include foam mattresses and gel and/or air cushions and/or mattresses which attempt to redistribute support pressure away from bony prominences. For example, static air mattresses include those disclosed in U.S. Pat. No. 4,685,163 to Quillen et al., U.S. Pat. No. 5,369,828 to Graebe and U.S. Pat. No. 5,282,286 to MacLeish. Static devices are undesirable because they require frequent turning and repositioning of the patient by health care workers and do not maintain pressure relief below the 32 mm Hg capillary occlusion pressure threshold.

Dynamic devices, such as alternating air mattresses, function by alternately shifting support pressure. Generally, these devices can be divided into two general types, no air loss devices which are made of an air and liquid impervious material and are, therefore, airtight, and those which are made of materials or supplied with additional manifolds to provide for low air loss from the device.

No air loss air devices include, for example, those disclosed in U.S. Pat. No. 5,509,155 to Zigarac et al., U.S. Pat. No. 4,833,614 to Saitoh et al., U.S. Pat. No. 4,864,671 to Evans, U.S. Pat. No. 5,500,965 to Hannagan et al., U.S. Pat. No. 5,010,608 to Barnett et al., U.S. Pat. No. 5,243,721 to Teasdale, U.S. Pat. No. 4,953,247 to Hasty, U.S. Pat. No. 4,852,195 to Schulman, U.S. Pat. No. 4,796,948 to Paul et al., and U.S. Pat. No. 4,175,297 to Robbins et al. These devices, while alternately shifting support pressure are problematic due to the build up of heat and moisture at points of interface between the mattress and a patient, which leads to skin maceration and ultimately decubitus ulcer formation.

Low air loss devices, for example, are disclosed in U.S. Pat. No. 5,003,654 to Vrzalik, U.S. Pat. No. 5,267,364 to Volk, U.S. Pat. No. 5,103,518 to Gilroy et al., U.S. Pat. Nos. 5,193,237, 5,379,471 and 5,533,217 to Holdredge. Low air loss devices have been found to be particularly useful because these mattresses prevent the build up heat and moisture at points of interface between the mattress and a patient, which prevents skin maceration.

However, all of these devices have various shortcomings. For example, static devices require turning and repositioning of the patient. Alternating devices attempt to alleviate the problem of turning and repositioning by alternately inflating and deflating individual air sacks or groups of air sacks based on cyclic preselected time intervals. However, these devices, due to their alternating nature, produce areas of concentrated high pressure on the patient's body at the interface with the inflated portions and areas of little or no support on the patient's body at the deflated portions. Further, none of these devices provide a low air loss device which simultaneously prevents skin maceration due to the build up of heat and moisture at points of interface between the device and the patient, and is an active feedback system which provides for real time adjustments to the inflation pressure of the air mattress in response to an increase in the compressive pressure on a part of the mattress from shifting of the patient's weight or other causes.

Thus, what is needed then is a corrective, low air loss, dynamic patient body weight air support system which has active feedback pressure sensing and real time automatic pressure correction capabilities.

In view of the prior art as a whole at the time the present invention was made, it was not obvious to those of ordinary skill in the pertinent art how the needed dynamic patient body weight air support system could be provided. Further, it was not obvious to those of ordinary skill in the pertinent art how a dynamic patient body weight air support system having active feedback pressure sensing and real time automatic pressure correction capabilities could be provided which maintained pressures below the 32 mm Hg capillary occlusion pressure given the reduced surface area of a wheelchair seat.

SUMMARY OF THE INVENTION

In accordance with the present invention, a patient body weight air support system which has a plurality of elongated independently sealed, air impermeable, inflatable chambers arranged in a longitudinally proximal side-by-side relationship is disclosed. Each of the inflatable chambers has a bottom surface, a top body weight supporting surface and a longitudinal axis. In addition, the top body weight supporting surface has venting means to provide for low air loss from the plurality of inflatable chambers. The inflatable chambers are arranged in a first group of chambers which are in spaced relationship with each other and a second group of chambers which are in a spaced relationship with each other and in an alternating proximal spaced relationship with the first group to form the plurality of chambers. A first conduit means is connected to the first group of inflatable chambers and a second conduit means is connected to the second group of inflatable chambers.

The system is also provided with a pump means for inflating the plurality of inflatable chambers. The pump means is in open communication with and connected to the first and second conduit means. A profile means for storing a compendium of data based upon projected patient body weight having a correlation to a desired internal pressure value for the plurality of inflatable chambers is provided. A pressure sensor means including means for detecting in real time the actual internal air pressure of the plurality of inflatable chambers is also provided. Further the device has a control means including comparator means for comparing the desired internal pressure value of the plurality of inflatable chambers with the actual internal air pressure of the plurality of inflatable chambers and further includes a pressure compensation means for adjusting pump means operation. The control means is activated by active feedback data derived from the comparator means for maintaining the desired internal pressure value of the plurality of inflatable chambers. The control means actuates the pressure compensation means for adjusting pump means operation to maintain the desired internal pressure value of the plurality of inflatable chambers. The pump means simultaneously adjusts the inflation of the first and second groups of inflatable chambers. The control means is connected to the first and second conduit means and the pump means.

The control means is programmed to monitor the profile means for storing a compendium of data based upon projected patient body weight having a correlation to a desired internal pressure value for the plurality of inflatable chambers, monitor the pressure sensor means including means for detecting in real time the actual internal air pressure of the plurality of inflatable chambers, actuate the indicator means to reflect the current state of the system, and actuate the pump means including means for venting the plurality of inflatable chambers for adjusting the inflation of the plurality of inflatable chambers corresponding to active feedback signals received from the comparator means to simultaneously adjust inflation of the first and second groups of inflatable chambers.

The invention accordingly comprises the features of construction, combination of elements and arrangement of parts that will be exemplified in the description hereinafter set forth, and the scope of the invention will be indicated in the claims.

BRIEF DESCRIPTION OF THE DRAWINGS

For a fuller understanding of the nature of the invention, reference should be made to the following detailed description, taken in connection with the accompanying drawings, in which.

DETAILED DESCRIPTION OF THE INVENTION

Figure 1:
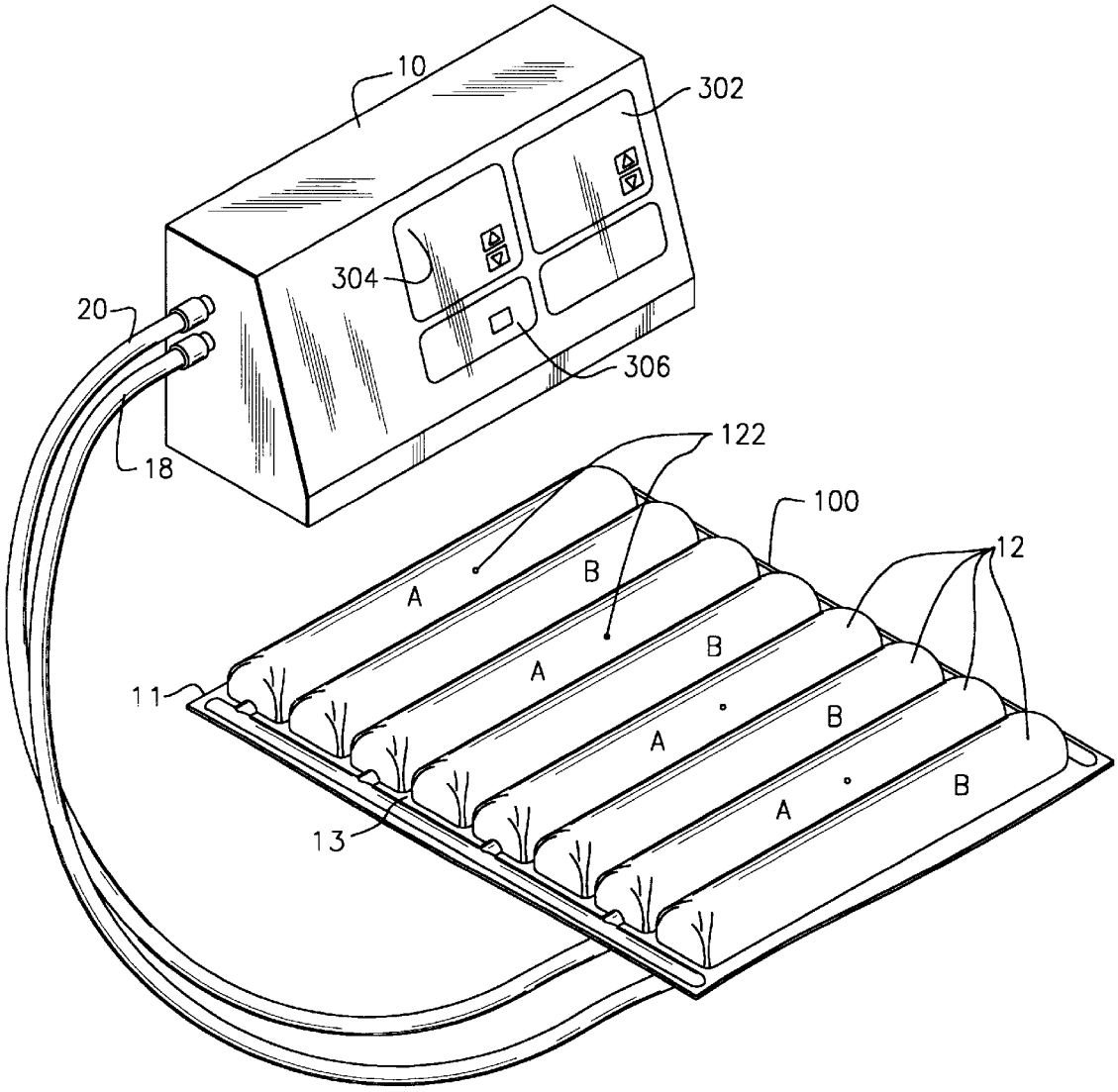
FIG. 1 is a top view of the control unit connected to the wheelchair cushion of the present invention.
Figure 2:
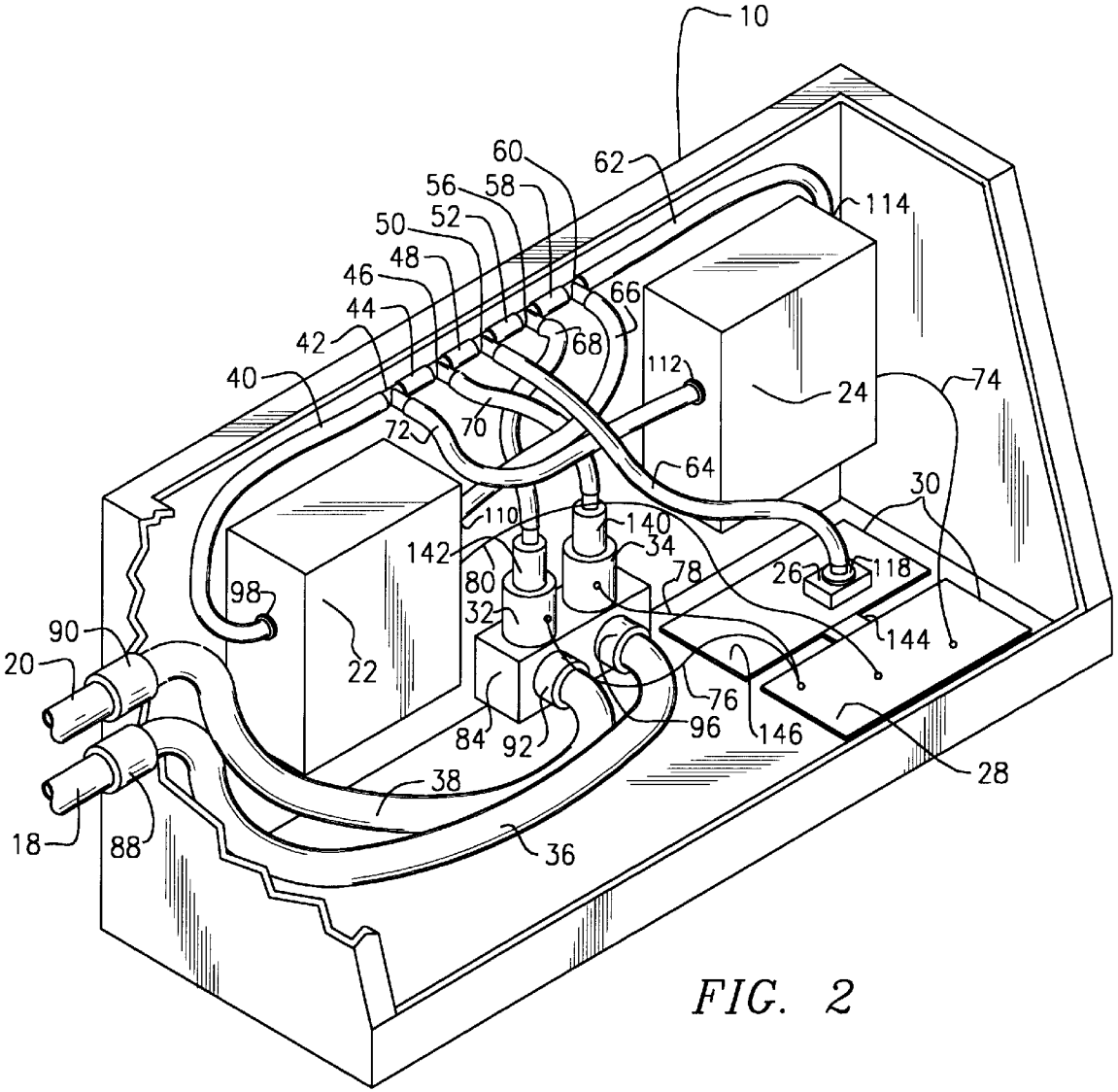
FIG. 2 is an open internal view of the control unit of the present invention.

Referring now to the drawings, in which like numerals refer to like elements thereof, FIG. 1 shows the control unit 10 of the novel patient body weight air support system of the present invention. As shown in FIG. 2, the control unit 10 has two pumps 22 and 24 for pumping air to the either the seat cushion 100 or the mattress 200. These pumps have a standard construction and any pump device commonly used by those skilled in the art is suitable for use in the present invention. Pumps 22 and 24 are arranged and connected in series. In this manner pumps 22 and 24 are connected to solenoids 32 and 34. Solenoids 32, 34 have ports 142, 140 respectively which are connected to tubing to form part of the active feedback circuit of the present invention. These solenoids have a standard construction and any solenoid device commonly used by those skilled in the art is suitable for use in the present invention. As shown in the drawing external hoses 18 and 20 are adapted to readily connect to the ports 88 and 90 of the control unit, respectively. These external hoses and ports have a standard construction and any such devices commonly used by those skilled in the art are suitable for use in the present invention. Tubing 38, 36 connects the ports 90, 88 respectively, with the ports 92, 96 respectively located on the solenoid base 84. As is known by those skilled in the art solenoid base 84 is readily constructed from commonly available materials and is in open communication with solenoids 32 and 34. Pumps 22, 24 have ports 98, 110 and 112, 114 respectively, which are connected via various tubing to form part of the active feedback circuit of the present invention. For purposes of the present invention and for use throughout the entire construction of the present invention any suitable tubing known in the art is useful.

The electronic control unit 30 is made up of two electronic circuit boards 146 and 28. Circuit boards 146, 28 are readily available and are commonly used in the art. Circuit boards 146, 28 are connected by a standard electronic connector 144 which is known in the art. Board 146 has contained thereon pressure transducer 26. Transducers useful in the present invention are commonly known in the art. Transducer 26 has port 118 which is connected in series to pumps 22, 24 to form part of the active feedback circuit. A manifold construction comprising connectors 42, 46, 50, 56, and 60 and tubing 44, 48, 52 and 58 also make up part of the active feedback circuit. Connectors 42, 46, 50, 56, and 60 are known in the art. Specifically, the following are connected in open communication: Pump 22 via port 98 and tubing 40 are connected to the manifold construction comprising connectors 42, 46, 50, 56, and 60 and tubing 44, 48, 52 and 58, connector 60 is connected to tubing 62 which is in turn connected to port 114 of pump 24; port 112 of pump 24 in connected to connector 42 via tubing 72; port 110 of pump 22 is connected to connector 60 via tubing 66; port 142 of solenoid 32 is connected to connector 56 via tubing 68, while port 140 of solenoid 34 is connected connector 46 via tubing 70; connector 50 of the manifold construction is connected to tubing 64 which is, in turn connected to port 118 of transducer 26; port 92 of solenoid base 84 is connected to port 90 via tubing 38 which in turn is connected to a seat cushion 100 or mattress 200 of the present invention via tubing 20, while port 96 of solenoid base 84 is connected to port 88 via tubing 36 which in turn is connected to a wheelchair seat cushion 100 or mattress 200 of the present invention via tubing 18. Pumps 22 and 24 are in communication with electronic control unit 30 via conduits 80 and 74, respectively. Further solenoids 32 and 34 are in communication with electronic control unit 30 via conduits 76 and 78, respectively. Conduits 80, 74, 76, and 78 are known in the art.

According to the present invention back pressure from the cushion 100 or the mattress 200 is sampled frequently, such as, every 11 seconds through the output of the transducer 26.

As is known in the art this signal is then amplified and, subsequent to amplification the signal is converted from an analog to a digital signal. This converted signal is then fed to the comparator means which is part of the electronic control unit 30. The comparator means compares the transducer signal to a preset preprogrammed pressure profile which was determined by the initial pressure profile determined for that particular patient. If a pressure variation from the preset pressure profile is sensed by the comparator means the control means which is part of the electronic control unit 86 will cause an interrupt signal and will halt the scan mode and either cause the solenoids 32, 34 to open thus venting air to lower the internal pressure of the chambers or turn on the pumps 22, 24 to add pressure to the plurality of chambers. This process of pressure correction can occur up to 327 times per hour. In this way, the present invention constantly maintains the interface pressure to below 32 mm Hg.

As shown in FIG. 1 the control unit display panel is represented as a whole by numeral 10. The display panel at 302 indicates the mode of operation of the device, while at 304 override functions are represented and the power switch and indicator is indicated at 306.

Figure 3:
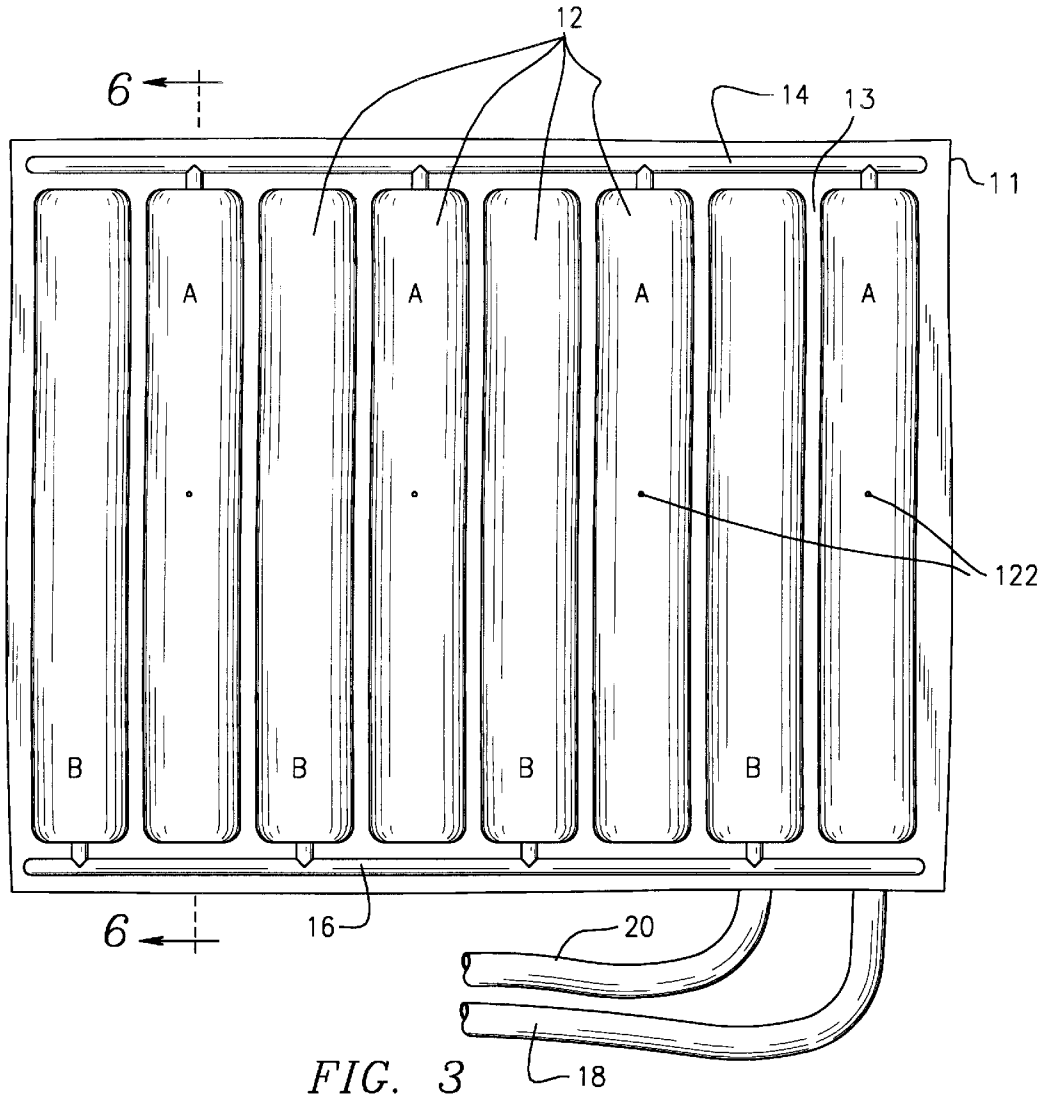
FIG. 3 is a top view of the wheelchair seat cushion of the present invention.
Figure 4:
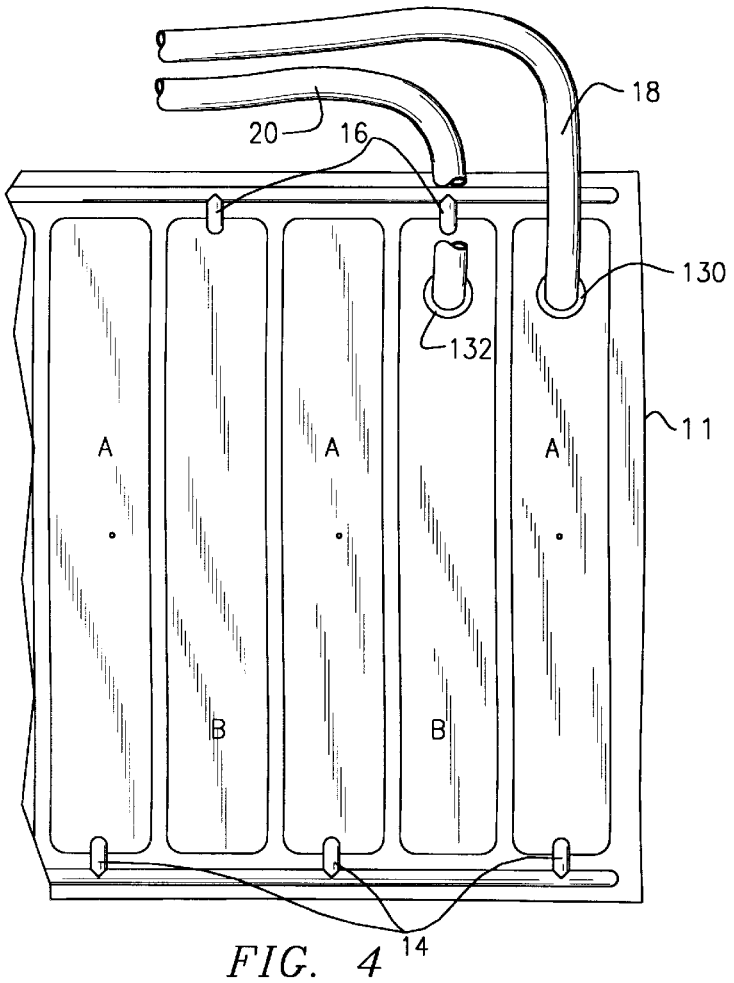
FIG. 4 is a bottom view of the wheelchair seat cushion of the present invention.
Figure 5:
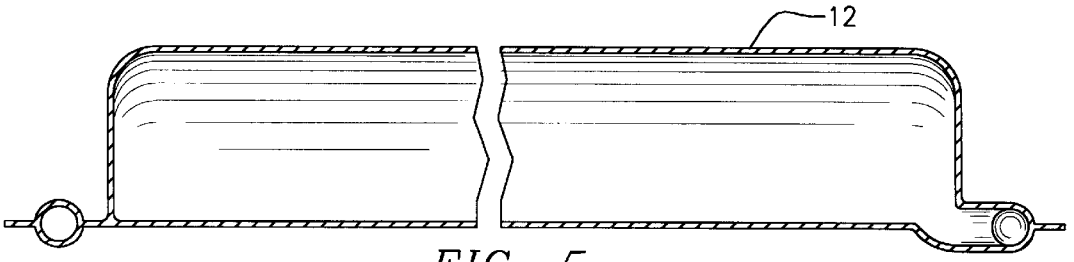
FIG. 5 is a cross-sectional view of the wheelchair seat cushion of the present invention.
Figure 6:
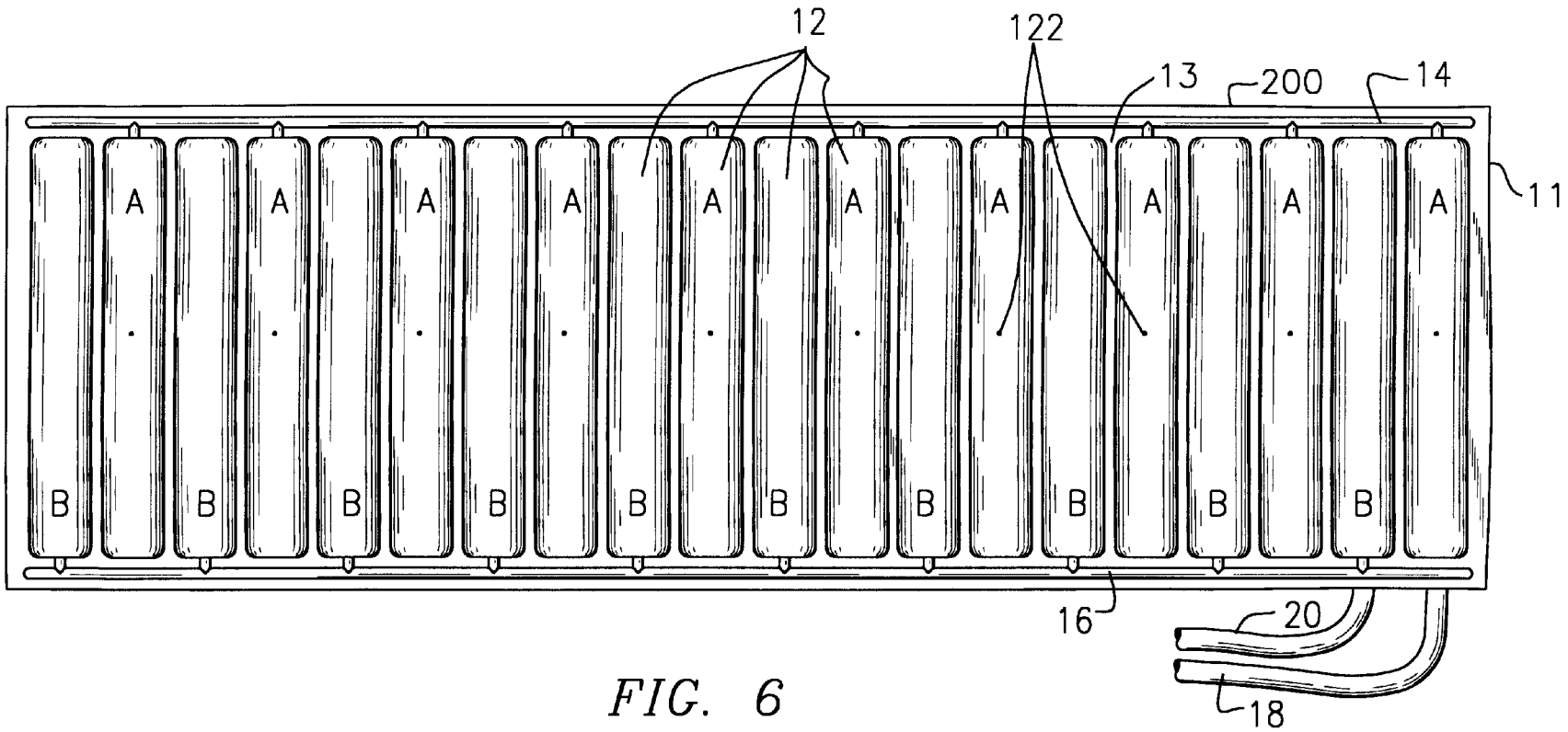
FIG. 6 is a top view of the mattress of the present invention.

FIGS. 3 and 4 show the wheelchair seat cushion 100 according to the present invention, while FIG. 6 shows the mattress 200 according to the present invention. The wheelchair seat cushion 100 and the mattress 200 as shown in the drawings are comprised of a plurality of inflatable chambers represented by numeral 12. A first group of inflatable chambers (A) are connected a first conduit means 14. A second group of inflatable chambers (B) are connected a second conduit means 16. As shown in the drawings each alternating inflatable chamber 12 has a vent means 122 for the purpose of venting air continuously against the inside layer of a vapor permeable, fluid impermeable nylon cover, not shown. The first group of inflatable chambers has a connector 130 for connection to tubing 18. The second group of inflatable chambers has a connector 132 for connection to tubing 20.

FIGS. 1 and 3, taken together, depict how each individual chamber of the wheelchair seat cushion is mounted. The lowermost edge of each of the four sidewalls of each chamber is formed integrally with a common bottom wall 11, and a space 13 is provided between each pair of contiguous chambers. Thus, when a chamber is independently inflated, each of its four side walls is disposed in a substantially upstanding configuration relative to bottom wall 11. In this way, each chamber, whether an A chamber or a B chamber, is independently secured to the bottom wall and is held in its operable position relative to said bottom wall.

Note further that conduit means 14 and 16 are formed integrally with bottom wall 11, thereby eliminating separate pipes and other conduit means of the type heretofore employed in connection with low air loss support systems.

As is known in the art numerous methods and devices can be utilized to make the vent means 122. In a preferred embodiment every A chamber of the wheelchair seat cushion 100 and the mattress 200 has a single venting means for continuously venting air, however, a plurality of vents are also contemplated. The vent means is useful in accelerating evaporation of moisture which accumulates under the patient and to maintain a cooler environment by dissipating heat through the evaporation process. As is known in the art, the vent means will be appropriately sized to accomplish these evaporation and cooling processes without interfering with the operation of the control means.

EXAMPLES

The following examples are presented to illustrate the invention, which is not intended to be in any limited thereto, since numerous modifications and variations therein will be apparent to one skilled in the art. Actual experimental data was obtained as follows:

Example 1

Interface pressure point testing was conducted on the corrective, low air loss, patient body weight air support bed mattress system according to the present invention. A Talley Oxford Pressure Monitor—Model MKII was used for this analysis. The mattress was placed directly on a standard hospital spring unit. The test methods employed for this analysis were based on sound laboratory practices. Precautions were employed to position the sensor correctly in each case. The pressure monitor was calibrated before and after each series of measurements.

Ten subjects were used for the analysis and selected according to specific weight and height ranges. The subjects were dressed in an appropriate size cotton sweat suit to ensure proper placement of the 4"×5" sensor pad. Positioning of the sensor pad was accomplished by both the subject and experimenter. The sensor pad was placed under the appropriate body part between the subject and the mattress. The control unit was individually programmed, as known in the art, for each subject in order to achieve optimum pressure displacement. It should be noted that in normal operation the system is preprogrammed with data based on projected patient body weights which are correlated to a desired internal pressure value for the mattress. Consequently, in normal operation the mattress automatically adjusts to an optimum desired internal pressure value without any programming by the user based upon these preprogrammed values. Three replications were conducted on each subject. The subject's height, weight, and gender are listed in Table 1 below.

TABLE 1

| Subject | Height | Weight | Sex |
|---|---|---|---|
| 1 | 5'3" | 105 lbs | F |
| 2 | 5'7" | 125 lbs | F |
| 3 | 5'5" | 125 lbs | F |
| 4 | 5'9" | 135 lbs | F |
| 5 | 5'6" | 140 lbs | F |
| 6 | 5'8" | 145 lbs | M |
| 7 | 5'6" | 160 lbs | M |
| 8 | 5'9" | 175 lbs | M |
| 9 | 5'8" | 190 lbs | M |
| 10 | 6'1" | 195 lbs | M |

The pressure measurements for various body parts for each of the subjects listed in Table 1 above are shown in Table 2 below.

TABLE 2

| (Low Air Loss Dynamic Mattress) Average Pressure (mm Hg) ± S.D. | | | | | | | | | | | | |
|---|---|---|---|---|---|---|---|---|---|---|---|---|
| | #1 | #2 | #3 | #4 | #5 | #6 | #7 | #8 | #9 | #10 | Ave. | ± S.D. |
| Scapula | 11 | 11 | 8 | 12 | 13 | 17 | 9 | 11 | 12 | 11 | 11 | ±3.9 |
| Sacral Prominence | 15 | 14 | 13 | 13 | 11 | 14 | 10 | 13 | 10 | 11 | 12 | ±5.3 |
| Heel | 8 | 6 | 6 | 10 | 8 | 6 | 6 | 10 | 7 | 8 | 7 | ±6.9 |
| Trochanter | 25 | 28 | 22 | 24 | 23 | 30 | 28 | 21 | 19 | 33 | 25 | ±7.4 |

As shown in Table 2 an air mattress in accordance with the present invention maintains interface pressures below the capillary closure pressure of 32 mm Hg. Further, the mattress of the present invention responded to the subject's weight and anatomical structure. A summary of the results shown in Table 2 are shown in Table 3 below.

TABLE 3

| (Low Air Loss Dynamic Mattress) Average Pressure (mm Hg)-All Subjects (10) ± S.D. | |
|---|---|
| Position | mm Hg ± S.D. |
| Scapula (Shoulder Blade) | 11 ± 3.9 |
| Sacral Prominence (Tailbone) | 12 ± 5.3 |
| Heel (Values cut off below 2 mm) | 7 ± 6.9 |
| Trochanter (Hip) | 25 ± 7.4 |

Example 2

Interface pressure point testing was conducted on the corrective, low air loss, patient body weight air support seat cushion system according to the present invention. The Talley Oxford Pressure Monitor—Model MKII used in Example 1 above was also used for this analysis. The seat cushion was placed in the collapsible seat of a Ventura Theradyne wheelchair. The cushion was covered with a nylon cover and had a 1" polyurethane foam base. Again, the test methods employed for this analysis were based on sound laboratory practices. Precautions were employed to position the sensor correctly in each case. The pressure monitor was calibrated before and after each series of measurements.

The subjects, listed in Table 1 above, were dressed in an appropriate size cotton sweat suit to ensure proper placement of the 4"×5" sensor pad. Positioning of the sensor pad was accomplished by both the subject and experimenter. The sensor pad was placed under the appropriate body part between the subject and the cushion. The control unit was individually programmed, as known in the art, for each subject in order to achieve optimum pressure displacement. Again, in normal operation the system is preprogrammed with data based on projected patient body weights which are correlated to a desired internal pressure value for the mattress. Consequently, in normal operation the cushion automatically adjusts to an optimum desired internal pressure value without any programming by the user based upon these preprogrammed values. Three replications were conducted on each subject. The subject's height, weight, and gender are listed in Table 4 below.

TABLE 4

| (Low Air Loss Dynamic Wheelchair Cushion) Average Pressure (mm Hg) ± S.D. | | | | | | | | | | | | |
|---|---|---|---|---|---|---|---|---|---|---|---|---|
| #1 | #2 | #3 | #3 | #4 | #5 | #6 | #7 | #8 | #9 | #10 | Ave. | +S.D. |
| Right Ischial Tuberosity | 30 | 25 | 27 | 28 | 25 | 35 | 32 | 35 | 39 | 34 | 31 | ±6.4 |
| Left Ischial Tuberosity | 33 | 29 | 25 | 30 | 27 | 34 | 34 | 30 | 33 | 38 | 31 | ±5.4 |
| Sacral prominence (Coccyx) | 25 | 27 | 32 | 28 | 28 | 30 | 31 | 27 | 34 | 30 | 29 | ±6.3 |

As shown in Table 4 an air seat cushion in accordance with the present invention maintains interface pressures below the capillary closure pressure of 32 mm Hg. Further, the seat cushion of the present invention responded to the subject's weight and anatomical structure. A summary of the results shown in Table 4 are shown in Table 5 below.

TABLE 5

| (Low Air Loss Dynamic Wheelchair Cushion) Average Pressure (mm H9)-All Subjects (10) ± S.D. | |
|---|---|
| Position | mm Hg ± S.D. |
| Right Ischial Tuberosity | 31 ± 6.4 |
| Left Ischial Tuberosity | 31 ± 5.4 |
| Sacral Prominence (Coccyx) | 29 ± 6.3 |

These results clearly show the unexpected advantages of this invention over the prior art devices. This invention maintains interface pressures below the capillary closure pressure while providing low air loss to prevent skin maceration. Further, the system automatically adjusts the internal pressure of the mattress to maintain interface pressures below the capillary closure pressure based on real time internal pressure measures.

The advantages of the present invention will thus be seen, and those made apparent from the foregoing description, are efficiently attained. Since certain changes may be made in the foregoing description without departing from the scope of the invention, it is intended that all matters contained in the foregoing description shall be interpreted as illustrative and not in a limiting sense.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A patient body weight support system comprising:

a flat bottom wall sized and configured for removable mounting atop a seat;

a plurality of elongated independently sealed, air impermeable, inflatable chambers arranged in a unidirectional longitudinally spaced apart, side-by-side relationship on a top surface of said flat bottom wall, each of said chambers extending from a point juxtaposed a first edge of said flat bottom wall to a point juxtaposed a second edge of said flat bottom wall, said second edge being longitudinally opposed from said first edge;

each of said chambers having a top body weight supporting surface, including at least one venting means located on the top surface of each chamber, a longitudinal axis, four sidewalls, and each of said sidewalls having a lowermost edge integrally secured to said flat bottom wall;

the chambers further comprising a first group of inflatable chambers, each chamber of said first group being in a parallel spaced relationship with each other and a second group of inflatable chambers, each chamber of said second group being in a parallel spaced relationship with each other and in alternating proximal spaced relationship with each chamber of said first group, thereby forming the plurality of chambers;

a conduit means being in independent fluid communication with each group of said plurality of chambers, said conduit means formed integrally with said bottom wall, and said conduit means being provided for independently introducing air under pressure into the first or second group or both groups of said plurality of chambers and for independently removing air from the first or second group or both groups of said chambers;

pressure sensor means including means for detecting in real time the actual internal air pressure of the plurality of inflatable chambers; and control means including comparator means for comparing a desired internal pressure value of the plurality of inflatable chambers with the actual internal air pressure of the plurality of inflatable chambers, the control means further including pressure compensation means for adjusting said actual internal air pressure, the control means activated by active feedback data derived from the comparator means for maintaining a desired internal pressure value of the plurality of inflatable chambers by simultaneously adjusting the inflation of the first and second groups of inflatable chambers, the control means connected to the first and second conduit means and a pump means for inflating the plurality of inflatable chambers, whereby each chamber of said plurality of chambers is independently mounted of each other chamber so that each chamber reacts to air pressure changes independently of air pressure changes in said other chambers, thereby redistributing the air pressure within each chamber without the need for manually adjusting the inflation pressure by a user as the user's weight is shifted, whereby an interface pressure is maintained at any point on the top surface of each of said plurality of chambers which is engaged with an anatomical portion of the user's body, at an average pressure below a capillary occlusion pressure threshold of 32 mm Hg, and whereby each chamber of said plurality of chambers is maintained in its position by means of its sidewalls being secured to said flat bottom wall at their respective lowermost edges.

2. The patient body weight support system according to claim 1 including profile means for storing a compendium of data based upon projected patient body weight having a correlation to the desired internal pressure value for the plurality of inflatable chambers.

3. The patient body weight support system according to claim 1 further comprising means for selectively interrupting the control means without disengaging the control means.

4. The patient body weight support system according to claim 2 wherein the control means is programmed to monitor the profile means for storing the compendium of data, monitor the pressure sensor means including means for detecting in real time the actual internal air pressure of the plurality of inflatable chambers, and actuate the pump means.

* * * * *